United States Patent [19]

Reznik

[11] Patent Number: 4,694,586

[45] Date of Patent: Sep. 22, 1987

[54] APPARATUS AND METHOD FOR DRYING AND CURING COATED SUBSTRATES

[76] Inventor: David Reznik, 2151 Barbara Dr., Palo Alto, Calif. 94303

[21] Appl. No.: 895,929

[22] Filed: Aug. 13, 1986

Related U.S. Application Data

[63] Continuation-in-part of Ser. No. 735,366, May 17, 1985.

[51] Int. Cl.[4] ..... F26B 23/08

[52] U.S. Cl. ..... 34/1; 118/620; 219/10.49 R; 219/10.79; 427/45.1; 427/46

[58] Field of Search ..... 34/1; 219/10.49 R, 10.79 R; 118/620; 427/45.1, 46

[56] References Cited

U.S. PATENT DOCUMENTS

| | | | |
|---|---|---|---|
| 2,364,526 | 12/1944 | Hansell | 118/620 |
| 3,058,840 | 10/1962 | Kerr et al. | 118/620 |
| 3,816,938 | 6/1974 | Podkletnov | 34/1 |
| 3,842,234 | 10/1974 | Seyfried | 219/10.79 |

*Primary Examiner*—Larry I. Schwartz

*Attorney, Agent, or Firm*—Cushman, Darby & Cushman

[57] ABSTRACT

Apparatus and method for drying or curing a coating on a metal substrate including inductivly heating the coated substrate in a highly confined space and condensing the evaporated liquid released as the result of the heating within the confined space at atmospheric pressure and room temperature. Ingress of atmospheric gases to the highly confined space is prevented without requiring locks or valves thus enabling a continuous flow of objects from the air into the highly confined space.

21 Claims, 6 Drawing Figures

APPARATUS AND METHOD FOR DRYING AND CURING COATED SUBSTRATES

REFERENCE TO CO-PENDING APPLICATIONS

This application is a continuation-in-part of U.S. patent application Ser. No. 735,366 filed May 17, 1985.

FIELD OF THE INVENTION

The present invention relates to apparatus and methods for drying and curing of coated substrates and more particularly to drying and curing of organically coated substrates.

BACKGROUND OF THE INVENTION

Conventionally, organic coated substrates are cured in hot air ovens in which the substrate is exposed to temperatures of the range 150°-210° C. for a dwell time of about 10 minutes. This conventional curing technique involves the disadvantage that the carrier solvent of the coating is evaporated and produces harmful air pollution if released to the atmosphere.

In practice, most of the hot air containing the solvent vapors is normally recirculated for energy conservation considerations and as a result, the solvent vapors must be incinerated, at a significant cost in energy.

Water based coatings have been developed in an effort to reduce the air pollution resulting from curing. These coatings also include a small proportion of organic solvents and are limited for certain applications such as canning of foods.

Coatings which are curable by exposure to intense Ultra-Violet radiation are also known. These suffer from the disadvantages of high cost and relatively poor quality, which render them unsuitable for interior coating of cans containing foods.

The few systems which utilize heating for the coating of strips either force nitrogen gas to pass through the solvents, allowing this mixture to be incinerated or cooled by means of liquid nitrogen. These methods are employed because a high concentration of noncondensible gas in the vapor significantly reduces the efficiency of condensation.

SUMMARY OF THE INVENTION

The present invention seeks to provide apparatus for curing coated substrates which enables high quality solvent-based substrates to be dried and/or cured without the disadvantages of prior art techniques and which provides additional economic advantages.

There is thus provided in accordance with a preferred embodiment of the present invention, apparatus for drying and/or curing a coating on a metal substrate comprising apparatus for inductively heating the coated substrate in a highly confined space and apparatus for condensing the solvent vapors released as the result of the heating.

The coating may be, for example, a conventional solvent-based or water-based coating, such that the evaporated liquids are normally conventional solvents and/or water.

Additionally in accordance with a preferred embodiment of the present invention, the apparatus for inductively heating comprises an AC electrical power supply and an induction coil coupled to the power supply and arranged in close proximity to the substrate to be dried and/or cured.

Further in accordance with a preferred embodiment of the present invention, the induction coil is arranged to define a conduit for the flow of coolant therethrough, whereby the induction coil, thus cooled, operates as a condenser for the evaporated liquid, forming part of the apparatus for condensing.

Additionally in accordance with a second preferred embodiment of the invention, the apparatus for condensing comprises cooling coil apparatus arranged at openings of the highly confined space for condensing the solvent vapor thereat, thereby to confine the solvent vapor atmosphere to the confined space.

Further in accordance with an embodiment of the invention, vapor generating apparatus is provided for maintaining a predetermined solvent vapor atmosphere within the confined space, thereby to prevent ingress thereof of air or other gases.

Additionally in accordance with an embodiment of the present invention, the apparatus for condensing is operative to condense the evaporated solvent at approximately atmospheric pressure.

Further in accordance with an embodiment of the present invention, the apparatus for condensing is operative to condense the evaporated solvent at approximately ambient temperature.

Additionally in accordance with an embodiment of the present invention, the apparatus for inductive heating provides drying in a dwell time of about 1 second and curing in a dwell time of approximately 3-10 seconds.

Further in accordance with an embodiment of the present invention, the power supply comprises an AC power supply.

Additionally in accordance with an embodiment of the present invention, there is also provided apparatus for rapid cooling of the coated substrate following curing which may include apparatus for spraying an atomized liquid, such as water droplets, onto the coated substrate.

Further in accordance with an embodiment of the present invention, there may also be provided apparatus for coating the substrate with the coating prior to heating. This coating device may comprise a dipping bath through which a coil of substrate is caused to pass.

Additionally in accordance with a preferred embodiment of the present invention, there is provided a method for heating and/or curing a coated conductive substrate comprising the steps of inductively heating the coated substrate in a highly confined space and condensing evaporated solvent released as the result of the heating.

Further in accordance with a preferred embodiment of the present invention, the step of inductively heating comprises the step of passing AC electrical power through an induction coil coupled to the power supply and arranged in close physical proximity to the substrate to be dried and/or cured.

Additionally in accordance with a preferred embodiment of the present invention, the step of condensing comprises the step of causing a flow of coolant through a conduit formed in the induction coil.

Further in accordance with a preferred embodiment of the invention, the step of condensing comprises the step of providing a flow of coolant through heat exchangers located at openings of the confined space to prevent egress therefrom of the evaporated solvent.

Additionally in accordance with an embodiment of the present invention, there is also provided the step of maintaining the vapor pressure of the evaporated solvent within the confined space at at least a predetermined vapor pressure, thereby to prevent ingress of air or other gases into the confined space.

Further in accordance with an embodiment of the present invention, the step of condensing is operative to condense the evaporated solvent at approximately atmospheric pressure.

Additionally in accordance with an embodiment of the present invention, the step of inductive heating provides drying in a dwell time of about 1 second and curing in a dwell time of approximately 3–10 seconds.

Additionally in accordance with an embodiment of the present invention, there may also be provided a step of rapid cooling of the coated substrate following curing which may include spraying a liquid, such as water, onto the coated substrate.

Further in accordance with an embodiment of the present invention, there may also be provided the step of coating the substrate prior to heating. This coating device may comprise dipping a coiled substrate in a dipping bath.

BRIEF DESCRIPTION OF THE DRAWINGS

The present invention will be understood and appreciated more fully from the following detailed description taken in conjunction with the drawings in which.

DETAILED DESCRIPTION OF THE INVENTION

Figure 1:
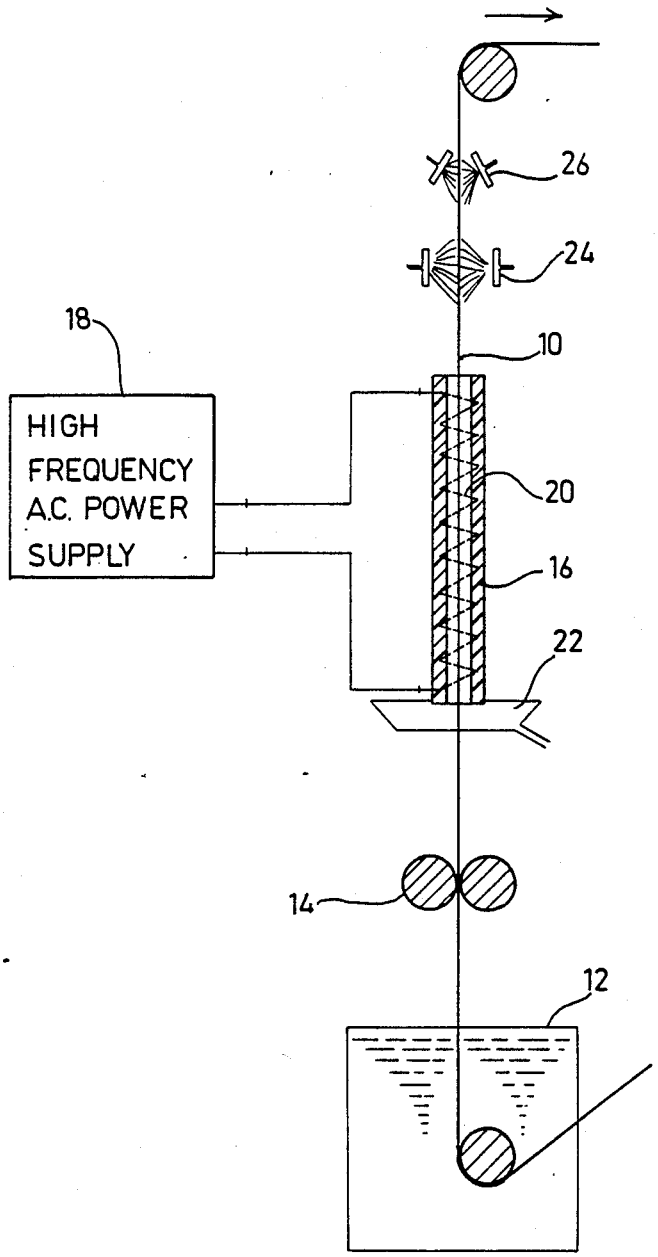
FIG. 1 is a schematic illustration of apparatus for coating and curing a substrate in accordance with a preferred embodiment of the present invention.

Reference is now made to FIG. 1, which illustrates apparatus for coating and curing a web substrate in accordance with a preferred embodiment of the present invention. In the illustrated embodiment, the web substrate is in the form of a coil, such as coil of tinplate, it being appreciated that sheets of tinplate or other substrate may be coated in a similar manner using conventionally available sheet feeding techniques.

A substrate 10, such as tinplate, is preferably first subjected to surface treatment in accordance with the teachings of applicant's U.S. Pat. No. 4,448,875 and is then supplied to a coating bath 12 which contains a coating material, such as an organic coating which may be entirely solvent based, or partially water based, for example. Excess coating material is allowed to run down the vertically aligned surface of substrate 10 as it leaves bath 12.

A pair of adjustably positionable rubber rollers 14 serve to remove excess coating material from the substrate suface and to position the substrate. Downstream of rollers 14, the substrate is supplied to a curing unit generally indicated by reference numeral 16.

Figure 3:
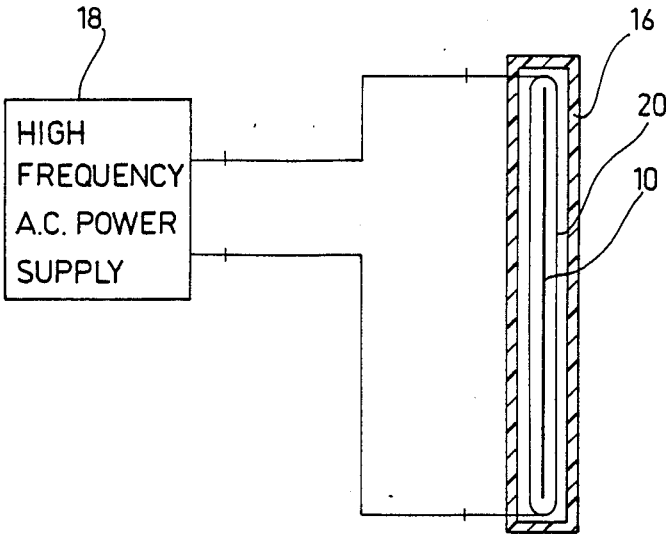
FIG. 3 is a sectional illustration of the arrangement of the induction coils about the substrate in the embodiment of FIG. 1.

According to a preferred embodiment of the present invention, curing unit 16 comprises a high frequency AC power supply 18 which supplies AC power, typically at a voltage of 440 V and a frequency of 450 kHz through an induction coil 20 which is wound in a generally rectangular cylindrical arrangement, as seen in FIG. 3, so as to define very close tolerances with the substrate passing therethrough but without permitting electrical contact or arcing to take place between the two.

Accordingly, the configuration of curing unit 16 defines a very small volume which surrounds the substrate during curing thereof. To the extent practical, this volume is sealed off from the outside atmosphere so as to provide efficient condensation of the saturated vapors therein at ambient temperature and pressure.

Flow of electrical AC current through induction coil 20 produces induction heating of conductive substrate 10, thereby heating the substrate, typically to a temperature of about 450°–500° F. The heat of the substrate is transmitted to the coating by conduction, thereby producing drying of the coating within about 1 second and curing thereof within about 3–10 seconds. During drying and curing, solvent from the coating is evaporated into the very small volume surrounding the substrate.

In accordance with a preferred feature of the present invention, induction coil 20 is formed as a hollow tube and defines a conduit through which a cooling fluid can be passed. Typically, this cooling fluid is water at room temperature. The flow of the cooling fluid cools induction coil 20 and enhances condensation of the evaporated solvent thereon at generally atmospheric pressure. The condensate runs down the induction coil by gravity and is collected at atmospheric pressure in a collection tray 22, which may communicate with a suitable collection assembly for permitting recycling of the condensed solvent. Other evaporated liquids such as water may also be condensed by the same apparatus.

It is a particular feature of the present invention that the provision of a small volume surrounding the substrate during curing and condensation enables enhanced efficiency of condensation and recovery of solvents. The use of induction heating in a small volume provides very significant savings in energy, not only in terms of recycled solvents but also in terms of the energy used to heat the substrate. As compared with the prior art, wherein only about 8% of the energy expended went into heating of the substrate, according to the present invention, virtually all of the induction energy goes to heating of the substrate.

Downstream of curing unit 16 there may be provided an atomized water spray 24 for rapid cooling of the coated, cured substrate. Water spray 24 may be followed by an air blast 26 for providing rapid drying of the coated substrate. The coated substrate may then be recoiled or employed as desired.

Figure 2:
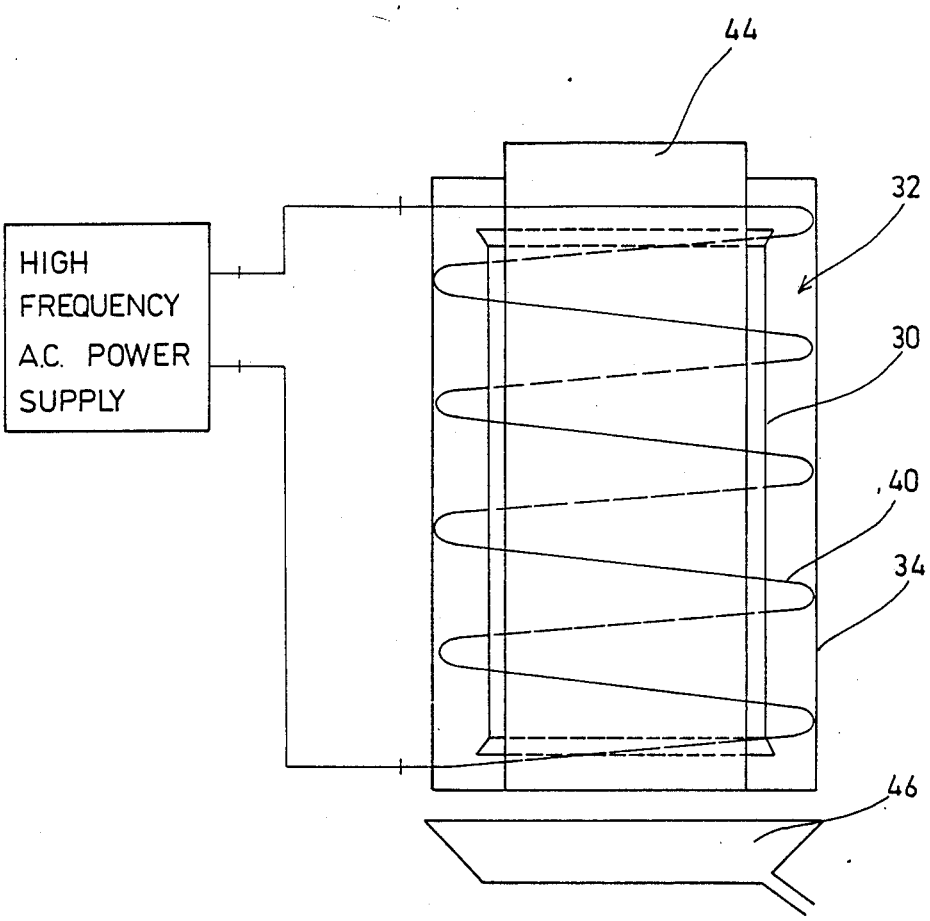
FIG. 2 is a schematic illustration of apparatus for curing an internally coated cylinder in accordance with a preferred embodiment of the present invention.
Figure 4:
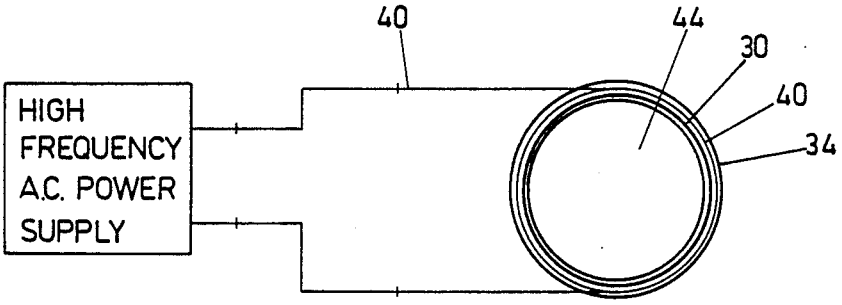
FIG. 4 is a sectional illustration of the arrangement of the induction coils about the substrate in the embodiment of FIG. 2.
Figure 5:
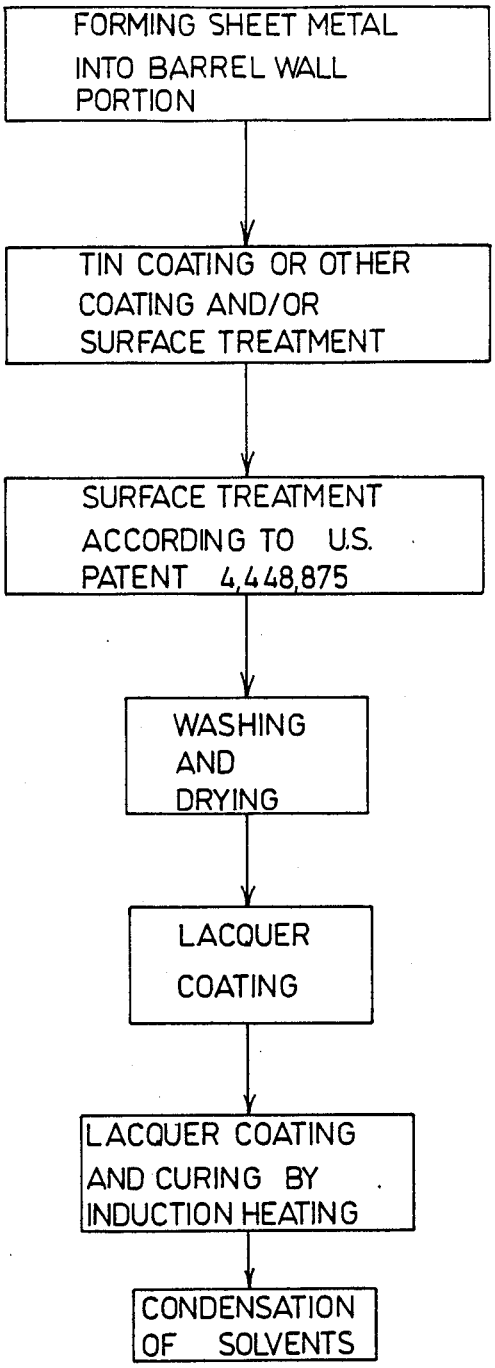
FIG. 5 is a flow chart diagram illustrating the technique of barrel manufacture employing the apparatus of FIGS. 2 and 4.

Reference is now made to FIGS. 2, 4 and 5, which illustrate the apparatus and technique for curing coated barrels in accordance with a preferred embodiment of the present invention. As a first step, sheet metal of a suitable thickness is formed into a cylinder corresponding to a barrel wall portion 30. A tin coating may be applied to the cylinder by conventional techniques, such as electroplating. Alternatively, any other suitable coating or surface treatment may be applied to the cylinder. One or both surfaces of the barrel wall cylinder may be so coated.

The tin-coated surface or surfaces of the barrel wall cylinder are next preferably subjected to surface treatment in accordance with the teachings of applicant's U.S. Pat. No. 4,448,875, the teaching of which is incorporated herein by reference. The cylinder is then washed and dried.

Following the surface treatment and washing and drying steps, the interior and/or exterior surfaces of the barrel wall portion 30 is coated with lacquer by conventional techniques, such as spraying. Following the lacquer coating step, the barrel wall cylinder is inserted into a curing unit of the type illustrated in FIGS. 2 and 4. As seen in FIG. 2, the curing unit, indicated generally by reference numeral 32, comprises a nonconductive housing 34, formed typically of plastic.

Disposed adjacent the interior surface of housing 34 is an induction coil 40, which may be substantially the same in construction and operation as induction coil 20 described hereinabove in connection with the embodiment of FIGS. 1 and 3. Induction coil 40 may include a coolant channel and means for causing a coolant such as water to pass therethrough for cooling thereof, and enhanced condensation of evaporated solvent thereon.

Induction coil 40 is coupled to a source of AC electrical power via suitable control apparatus, not illustrated. Barrel wall cylinder 30 to be treated is located interiorly of induction coil 40.

Disposed interiorly of barrel wall cylinder 30 and closely spaced therefrom is a container 44, typically formed of a suitable material such as plastic or metal, which is filled with water or any other suitable liquid. Suitably filled container 44 serves to reduce the volume inside housing 34 in which the solvent can evaporate from the coating during drying and curing and is provided for the reasons described hereinabove in connection with the embodiment of FIGS. 1 and 3.

According to a preferred embodiment of the invention, filled container 44 also defines a relatively cool surface upon which condensation of evaporated solvent can occur. A condensate collector 46 is therefore provided, underlying container 44.

Where both inside and outside surfaces of the barrel wall cylinder 30 are sought to be cured or dried, both container 44 and the cooled induction coil 40 serve as condensation surfaces.

As described hereinabove in connection with the embodiment of FIGS. 1 and 3, solvents released during the lacquer drying and curing step are recovered by condensation thereof at container 44 and induction coil 40, and are drained into and subsequently removed from a collector 46.

The lacquer curing step may be carried out simultaneously with a flow brightening step by reaching a substrate temperature of 450°-500° F. for 10-20 seconds.

The simultaneous provision of lacquer curing and condensation is a particular feature of the present invention, savings costs in equipment, time and space, as well as permitting recycling of the solvents.

The use of induction heating of the substrate in a very restricted volume has the significant advantages of large energy savings and prevention of pollution.

Upon completion of the induction heating step and condensation of the excess solvent, barrel wall cylinder 30 is then assembled into a complete barrel with top and bottom end portions.

Figure 6:
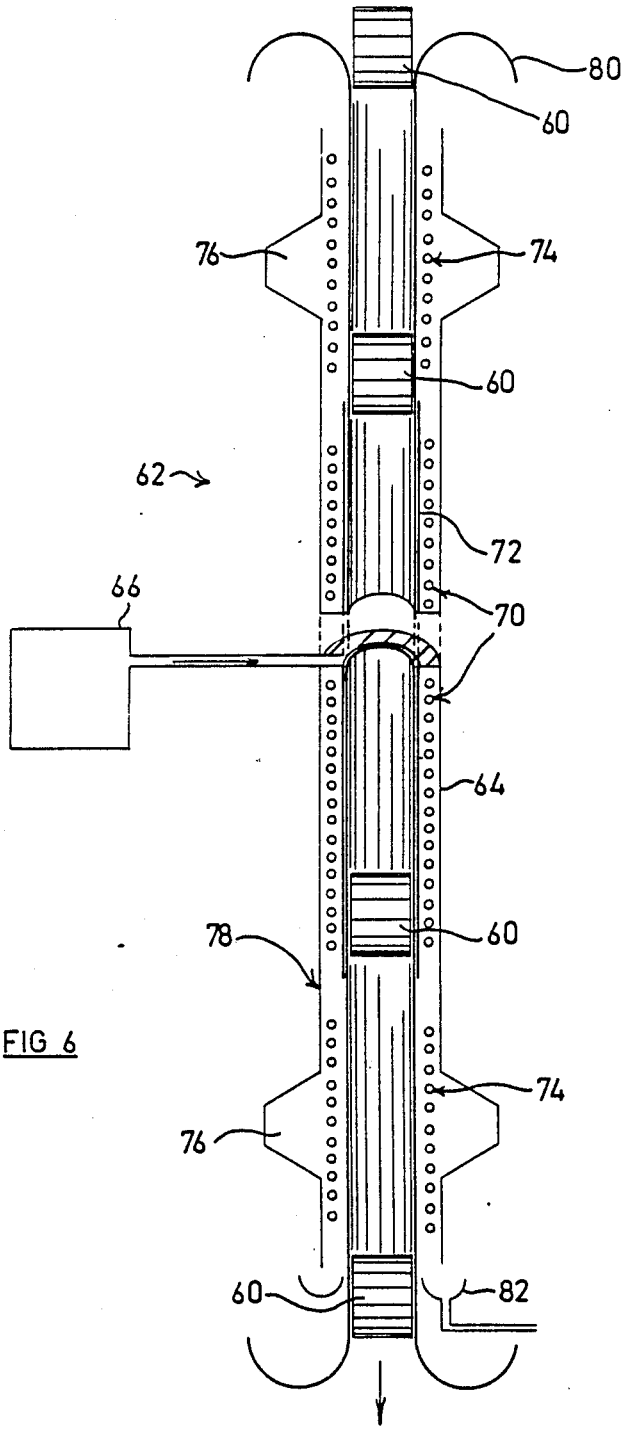
FIG. 6 is a schematic illustration of apparatus for curing a coated cylinder in accordance with an alternative preferred embodiment of the present invention.

Reference is now made to FIG. 6, which illustrates the apparatus and technique for curing coated cylinders such as can bodies in accordance with an alternative preferred embodiment of the present invention. There is provided a curing unit, indicated generally by reference numeral 62, comprising an elongated, nonconductive cylindrical housing 64 which is typically of plastic, ceramic or metal and which is integrally formed with two widened regions 76, an induction coil 70 and two cooling coils 74.

Induction coil 70 is coupled to a source of AC electrical power via suitable control apparatus, not illustrated. It is arranged adjacent to and internally of housing 64 and is similar to the induction coils described hereinabove with reference to FIGS. 1, 2, 3, 4 and 5, the only significant difference being that induction coil 70 need not be formed as a hollow tube, there being no need to pass coolant therethrough.

Provided internally of and adjacent to induction coil 70 is a sleeve or guide 72 which is made of a non-conductive material, typically plastic or ceramic. The diameter of sleeve 72 is such that it is only slightly larger than that of a can wall cylinder 60 that it is wished to pass therethrough for the purposes of curing.

The two cooling coils 74 are provided internally of an adjacent to housing 64, and are located one at each end of induction coil 70 adjacent the openings.

There may additionally be provided a solvent vapor generator 66 having an outlet into curing unit 62 at the center of the induction zone.

A method of curing organic coating applied to steel based cylinders will now be described with reference to FIG. 6. As a first step, sheet metal of a suitable thickness is formed into a cylindrical shape, shown by reference numeral 60. A coating may be applied to the cylindrical by conventional techniques, such as electroplating. Alternatively, any other suitable coating or surface treatment may be applied to the cylinder. One or both surfaces of the can cylinder may be so coated.

The tin-coated surface or surfaces of the can wall cylinder are next preferably subjected to surface treatment in accordance with the teachings of applicant's U.S. Pat. No. 4,448,875, the teaching of which is incorporated herein by reference. The cylinder is then washed and dried.

Following the surface treatment and washing and drying steps, the interior and/or exterior surfaces of the can or drum cylinder 60 is coated with lacquer by conventional techniques, such as spraying. Following the lacquer in the coating step, the cylinder is placed on a conveyor 80. Cylinder 60 is then introduced into the center of the curing unit 62, which unit, although normally arranged vertically for can cylinders, as shown, need not be so arranged. Heavy cylinders such as barrels should be processed in a horizontal unit.

Solvent vapor, generated in the interior of curing unit 62 as the result of evaporation of the solvent coating on can 60 during curing, may also be generated by solvent vapor generator 66 and introduced into housing 62 at location 78. Cooling coils 74, through which water may typically be passed, ensure that solvent vapor does not escape outside of housing 62 as any solvent vapor coming in contact therewith immediately condenses and runs down by gravity into a solvent recovery tray 82. Efficient condensation is achieved by the absence of gas vapors.

It is a particular feature of the present invention that neither air, nor any other atmospheric gas may enter the volume define internally of induction coil 70, as the vapor pressure inside this volume is maintained at atmospheric pressure or slightly above it. Solvent vapor generator 66 may be operated so as to provide solvent vapor when the vapor pressure or volume inside the curing section 62 falls below a desired level.

It is thereofre a particular feature of this invention that no valve or similar apparatus is required to isolate the interior of curing unit 62 from the otuside atmosphere.

An additional feature of the present invention is the provison of widened regions 76. At this region a sharp borderline between air and solvent vapor is maintained. Due to their large width relative to to width of sleeve 72, there is a reduced possibility that any turbulence adjacent to either end of curing unit 62 will cause entry of unwanted noncondensible gases inside of the curing unit 62.

The cylinder 60 is heated, typically to a temperature of 450°-500° F. through induction heating, produced as a result of passing a flow of electrical AC current through induction coil 70. The heat of the cylinder wall material is transmitted to the coating by conduction, thereby producing drying of the coating within about 1 second and curing thereof within about 3-10 seconds.

The lacquer curing step may be carried out simultaneously with a flow brightening step by reaching a substrate temperature of 450°-500° F. for 10-20 seconds.

After curing is completed, the can 60 is conveyed out of and away from curing unit 62, having first passed through cooling coil 74 which serves to condense any evaporated solvent. The simultaneous provision of lacquer curing and condensation is a particular feature of the present invention, savings costs in equipment, time and space, as well as permitting recycling of the solvents.

It will be appreciated by persons skilled in the art that the present invention is not limited to what has been particularly shown and described hereinabove. Rather, the scope of the present invention is defined only by the claims which follow.

I claim:

1. Apparatus for drying or curing a coating on a metal substrate comprising:

means for inductively heating said coated substrate in a highly confined space; and means for condensing evaporated liquids released as the result of said heating, said means for inductively heating and means for condensing being operative for maintaining an atmosphere of evaporated liquids in said confined space, substantially to the exclusion of atmospheric gases.

2. Apparatus for drying or curing a coating on a metal substrate according to claim 1 and wherein said coatings comprise solvent-based or water-based coatings.

3. Apparatus for drying or curing a coating on a metal substrate according to claim 1 and wherein said means for inductively heating comprises an AC electrical power supply and an induction coil coupled to said power supply and arranged in close physical proximity to said substrate to be dried or cured.

4. Apparatus for drying or curing a coating on a metal substrate according to claim 1 and wherein said means for condensing is operative to condense the evaporated solvent at approximately atmospheric pressure.

5. Apparatus for drying or curing a coating on a metal substrate according to claim 1 and wherein said means for condensing is operative to condense said evaporated solvent at approximately ambient temperature.

6. Apparatus for drying or curing a coating on a metal substrate according to claim 1 and wherein said means for inductive heating provides drying in a dwell time of about 1 second and curing in a dwell time of approximately 3-10 seconds.

7. Apparatus for drying or curing a coating on a metal substrate according to claim 3 and wherein said power supply comprises a high frequency AC power supply.

8. Apparatus for drying or curing a coating on a metal substrate according to claim 1 and additionally comprising means for rapid cooling of said coated substrate following curing.

9. Apparatus for drying or curing a coating on a metal substrate according to claim 1 and wherein said means for condensing comprises cooling means disposed at openings of said highly confined space.

10. Apparatus for drying or curing a coating on a metal substrate according to claim 9 and also comprising vapor generating means for maintaining the vapor pressure within the highly confined space at a level higher than outside said highly confined space.

11. Apparatus for drying or curing a coating on a metal substrate according to claim 10 and also comprising widened regions adjacent the openings of said highly confined space for preventing turbulence therien.

12. Apparatus for drying or curing a coating on a metal substrate comprising:

means for inductively heating said coated substrate in a highly confined space; and means for condensing evaporated liquids released as the result of said heating, said means for inductively heating and means for condensing being operative for maintaining an atmosphere of evaporated liquids in said confined space, substantially to the exclusion of atmospheric gases, and wherein said means for inductively heating comprises an AC electrical power supply and an induction coil coupled to said power supply and arranged in close physical proximity to said substrate to be dried or cured, and said induction coil is arranged to define a conduit for the flow of coolant therethrough, whereby said induction coil, thus cooled, operates as a condenser for said evaporated liquid, forming part of said means for condensing.

13. A method for drying or curing a coated conductive substrate comprising the steps of inductively heating the coated substrate in a highly confined space and condensing evaporated solvent released as the result of the heating, said inductively heating and condensing steps being operative to maintain said evaporated solvent in said highly confined space and substantially to prevent ingress of atmospheric gase thereinto and wherein said step of condensing comprises the step of causing a flow of coolant through a conduit formed in said induction coil.

14. A method for drying or curing a coated conductive substrate comprising the steps of inductively heating the coated substrate in a highly confined space and condensing evaporated solvent released as the result of the heating, said inductively heating and condensing steps being operative to maintain said evaporated solvent in said highly confined space and substantially to prevent ingress of atmospheric gases thereinto and wherein said step of condensing involves the activation of at least two cooling coils which are arranged in proximity to openings of said confined space, thereby containing said evaporated solvent within said confined space.

15. A method for drying or curing a coated conductive substrate comprising the steps of inductively heating the coated substrate in a highly confined space and condensing evaporated solvent release as the result of the heating, said inductively heating and condensing steps being operative to maintain said evaporated solvent in said highly confined space and substantially to prevent ingress of atmospheric gases thereinto.

16. A method for drying or curing a coated conductive substrate according to claim 15 and wherein said step of inductively heating comprises the step of passing AC electrical power through an induction coil coupled to the power supply and arranged in close physical proximity to said substrate to be dried and/or cured.

17. A method for drying or curing a coated conductive substrate according to claim 15 and wherein said step of condensing is operative to condense said evaporated solvent at approximately atmospheric pressure.

18. A method for drying or curing a coated conductive substrate according to claim 15 and wherein said step of condensing is operative to condense said solvent at approximately ambient pressure.

19. A method for drying or curing a coated conductive substrate according to claim 15 and wherein said step of inductive heating provides drying in a dwell time of about 1 second and curing in a dwell time of approximately 3-10 seconds.

20. A method for drying or curing a coated conductive substrate according to claim 15 and wherein said inductive heating step comprises passing AC power through said induction coil.

21. A method for drying or curing a coated conductive substrate according to claim 15 and wherein said induction coil is also used as a condenser for said condensing step.

* * * * *